US011297888B2

(12) United States Patent
Walter et al.

(10) Patent No.: US 11,297,888 B2
(45) **Date of Patent: *Apr. 12, 2022**

(54) GARMENT WITH INTEGRAL WIPE ZONES

(71) Applicant: NIKE, Inc., Beaverton, OR (US)

(72) Inventors: Michelle Walter, Portland, OR (US); Tod Morrisey, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/996,629

(22) Filed: Jan. 15, 2016

(65) Prior Publication Data

US 2017/0202287 A1 Jul. 20, 2017

(51) Int. Cl.

| | |
|---|---|
| ***A41D 31/00*** | (2019.01) |
| ***A41D 27/28*** | (2006.01) |
| ***A41D 27/20*** | (2006.01) |
| ***A41D 31/12*** | (2019.01) |
| ***A41D 31/10*** | (2019.01) |

(52) U.S. Cl.

CPC ..... *A41D 27/28* (2013.01); *A41D 27/20* (2013.01); *A41D 31/00* (2013.01); *A41D 31/10* (2019.02); *A41D 31/12* (2019.02); *A41B 2400/22* (2013.01); *A41B 2400/60* (2013.01); *A41D 2500/10* (2013.01); *A41D 2500/20* (2013.01)

(58) Field of Classification Search

CPC ..... A42B 3/125; A42B 3/00; A42B 3/124; A63B 71/10; A63B 2102/14; A63B 2102/22

USPC ..... 2/247

See application file for complete search history.

(56) References Cited

U.S. PATENT DOCUMENTS

| | | | |
|---|---|---|---|
| 2,308,337 | A | 1/1943 | McDonald |
| 3,045,245 | A | 7/1962 | Kohen |

(Continued)

FOREIGN PATENT DOCUMENTS

| | | | |
|---|---|---|---|
| CN | 1871384 | A | 11/2006 |
| CN | 1920144 | A | 2/2007 |

(Continued)

OTHER PUBLICATIONS

International Search Report and Written Opinion dated Apr. 13, 2017 in International Patent Application No. PCT/US2017/013307, 15 pages.

(Continued)

*Primary Examiner* — Timothy K Trieu

(74) *Attorney, Agent, or Firm* — Shook, Hardy & Bacon L.L.P.

(57) ABSTRACT

Hydrophobic fabrics and garments made therefrom are provided. The fabrics and garments in accordance with aspects herein comprise at least two seamlessly adjacent woven zones, where the first fabric/garment zone comprises substantially planar surfaces, and the second fabric/garment zone comprises a plurality of integrally raised structures on at least one of the surfaces of the fabric/garment. The integrally raised structures in the second fabric/garment zone are continuously woven/knit with the first zone. The integrally raised structures in the second zone of the fabric/garment are provided on the garments, in accordance with aspects herein, as wipe zones for transferring fluids away from a wearer's skin upon the wearer rubbing their wet skin off on the wipe zone(s).

19 Claims, 9 Drawing Sheets

(56) References Cited

U.S. PATENT DOCUMENTS 3,174,156 A 3/1965 Dale et al.
3,511,608 A 5/1970 Anderson
3,741,856 A 6/1973 Hurst
3,911,498 A 10/1975 Van Staagen
4,232,128 A 11/1980 Michel et al.
1,541,129 A 9/1985 Murakami
4,554,682 A 11/1985 Hillquist
4,603,440 A 8/1986 Hale
4,608,715 A 9/1986 Miller et al.
4,651,348 A 3/1987 Swanson
4,768,236 A 9/1988 Klob
5,007,112 A 4/1991 Lewis, Jr. et al.
5,014,360 A 5/1991 Smith et al.
5,065,600 A 11/1991 Byles et al.
5,075,901 A 12/1991 Vollrath
5,090,060 A 2/1992 Gates
5,105,477 A 4/1992 Golde
5,164,253 A 11/1992 Greak
5,217,782 A 6/1993 Moretz et al.
5,441,436 A 8/1995 Moretz et al.
5,464,675 A * 11/1995 Weir ..... A41D 31/00 428/101
5,735,145 A 4/1998 Pernick
5,792,714 A 8/1998 Schindler et al.
5,889,737 A 3/1999 Alameh et al.
5,901,373 A 5/1999 Dicker
5,906,876 A 5/1999 Conway
6,199,210 B1 3/2001 Feldman
6,276,178 B1 8/2001 West et al.
6,427,242 B1 8/2002 Bush et al.
6,432,504 B1 8/2002 Yeh
6,446,472 B2 9/2002 West et al.
6,782,557 B1 8/2004 Feder
6,848,118 B2 2/2005 Barnes et al.
6,854,130 B2 2/2005 van der Sleesen
7,043,766 B1 5/2006 Foreman et al.
7,217,456 B1 5/2007 Rock et al.
7,497,097 B2 3/2009 Herr
7,560,399 B2 7/2009 Rock et al.
7,565,920 B2 7/2009 Li et al.
7,682,994 B2 3/2010 Van Emden et al.
7,743,476 B2 6/2010 Rock et al.
7,842,625 B1 11/2010 Stockton et al.
7,842,628 B2 11/2010 Yasui et al.
7,954,173 B2 6/2011 Collier
7,986,211 B2 7/2011 Kim et al.
D643,597 S 8/2011 Gaeir et al.
8,011,020 B2 9/2011 Vereen
8,051,495 B2 11/2011 Lee
8,176,569 B2 5/2012 Rock et al.
8,578,518 B1 11/2013 Pflug
8,629,070 B2 1/2014 Oles et al.
8,713,712 B2 5/2014 Maurer
8,756,714 B2 6/2014 Reimer
8,769,716 B2 7/2014 Luscher
8,806,663 B2 8/2014 White et al.
8,850,615 B2 10/2014 Demarest et al.
9,038,203 B2 5/2015 Curtis
9,107,459 B2 8/2015 Mayer et al.
9,522,207 B1 * 12/2016 Sesselmann ..... A41D 31/102
9,559,742 B2 1/2017 Ye et al.
9,677,207 B2 6/2017 Hurd et al.
9,733,669 B1 8/2017 Scales et al.
9,829,923 B2 11/2017 Lee
9,877,549 B2 1/2018 Perkins et al.
9,894,964 B2 2/2018 Perkins et al.
10,149,518 B1 12/2018 De Iuliis et al.
10,219,591 B2 3/2019 Hatanaka et al.
2003/0051286 A1 3/2003 Gregg
2004/0023578 A1 2/2004 Sobieski et al.
2004/0083529 A1 5/2004 Tate
2004/0132367 A1 * 7/2004 Rock ..... A41D 3/005 442/76
2004/0168479 A1 9/2004 McMurray
2005/0053759 A1 3/2005 Rock et al.
2005/0086721 A1 4/2005 Lambertz
2005/0095940 A1 5/2005 Rock et al.
2005/0176324 A1 8/2005 Michel
2005/0204449 A1 9/2005 Baron et al.
2005/0278820 A1 * 12/2005 Newman ..... A41D 31/00 2/69
2005/0282455 A1 12/2005 Foshee
2006/0063453 A1 3/2006 King
2006/0148356 A1 7/2006 Zhang et al.
2006/0277653 A1 12/2006 Okajima
2007/0093162 A1 * 4/2007 Holcombe ..... D03D 15/00 442/208
2007/0149093 A1 6/2007 Lutz
2008/0070477 A1 3/2008 Barbour et al.
2008/0104739 A1 5/2008 Kharazmi
2008/0189824 A1 8/2008 Rock et al.
2009/0049579 A1 2/2009 Roberts
2009/0095026 A1 * 4/2009 Araki ..... A41B 11/02 66/187
2011/0099680 A1 5/2011 Gordon et al.
2011/0263418 A1 10/2011 Lu et al.
2011/0302699 A1 12/2011 Kaneda et al.
2012/0064313 A1 3/2012 Rocke et al.
2012/0096622 A1 4/2012 Johnson
2012/0174281 A1 * 7/2012 Mayer ..... B32B 5/026 2/69
2012/0178343 A1 7/2012 Hurd et al.
2012/0222189 A1 9/2012 Sokolowski et al.
2012/0260422 A1 * 10/2012 Rock ..... A47G 9/0223 5/483
2013/0042380 A1 2/2013 Goodman
2013/0045651 A1 2/2013 Esteves De Sousa Fangueiro et al.
2013/0061366 A1 3/2013 Pezzimenti
2013/0117903 A1 5/2013 Kanayama
2013/0239289 A1 9/2013 Iwashita
2014/0043741 A1 2/2014 Smith et al.
2014/0059734 A1 * 3/2014 Toronjo ..... A43B 3/26 2/69
2014/0106138 A1 4/2014 Chung et al.
2014/0310986 A1 10/2014 Tamm et al.
2015/0047103 A1 2/2015 Dahlgren et al.
2015/0104604 A1 4/2015 Rock et al.
2016/0076176 A1 3/2016 Rock et al.
2018/0132545 A1 5/2018 Fromer et al.
2021/0145084 A1 5/2021 Szilagyi

FOREIGN PATENT DOCUMENTS

CN 101128313 A 2/2008
CN 102134776 A 7/2011
CN 202890542 U 4/2013
CN 103243472 A 8/2013
EP 0777978 A2 6/1997
EP 2940203 A1 11/2015
NO 2006002371 A2 1/2006
NO 2007107264 A1 9/2007
WO 2013145456 A1 10/2013
WO 2015064636 A1 5/2015

OTHER PUBLICATIONS

Office Action received for European Patent Application No. 17703509.4, dated Aug. 12, 2020, 4 pages.
Intention to Grant received for European Patent Application No. 17817344.9, dated Apr. 28, 2021, 4 pages.
Office Action received for European Patent Application No. 17703509.4, dated Apr. 29, 2021, 7 pages.
Non-Final Office Action received for U.S. Appl. No. 15/810,423, dated Mar. 4, 2020, 11 pages.
Office Action received for European Patent Application No. 17817344.9, dated Jul. 1, 2020, 3 pages.
Non-Final Office Action received for U.S. Appl. No. 15/810,423, dated Jun. 11, 2021, 14 pages.
Final Office Action received for U.S. Appl. No. 15/810,423, dated Sep. 15, 2020, 12 pages.

(56) References Cited

OTHER PUBLICATIONS

Final Office Action received for U.S. Appl. No. 15/810,423, dated Dec. 15, 2021, 10 pages.
International Preliminary Report on Patentability dated May 31, 2019 in International Patent Application No. PCT/US2017/061933, 11 pages.
International Preliminary Report on Patentability dated Jul. 26, 2018 in International Patent Application No. PCT/US2017/013307, 8 pages.

* cited by examiner

GARMENT WITH INTEGRAL WIPE ZONES

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Aspects herein are defined by the claims.

At a high level, aspects herein are directed to garments comprising integral wipe zones. The integral wipe zones in the garments may comprise a plurality of integrally raised structures that extend outward from the surface of the garment. The integrally raised structures provide a surface with higher friction than other garment surfaces that are substantially planar. In other words, the integrally raised structures provide more surface area to the otherwise substantially planar surface of the garment, to effectively wipe away moisture from an athlete's skin when the skin is rubbed against or otherwise moved across the integrally raised structures. In accordance with aspects herein, surfaces that are "substantially planar" may be defined as surfaces having components or structures that have a height that is 20% or less of the height of the integrally raised structures, where the height is measured perpendicularly from the plane of the fabric surface.

The garments in accordance with aspects herein may be made of warp/weft knitted or woven hydrophobic fabrics. When woven, the fabrics in accordance with aspects herein may exhibit high durability characteristics and be resistant to snagging. Further, the fabrics, when woven, may hold their shape, be less susceptible to shrinking and/or stretching, and be able to withstand multiple wash cycles without being deformed. Further properties of the fabrics may be varied by introducing yarns with different properties when knitting or weaving, such as elastic yarns to make the woven fabrics or knit fabrics more elastic in accordance with aspects hereof. Additionally, the fabrics used may be inherently hydrophobic due to, for instance, forming the fabrics from polyester fibers. Alternatively, the fabrics used may be natural or synthetic fabrics made hydrophobic by applying a hydrophobic coating such as a durable water repellent (DWR) coating to one or both surfaces of the fabric.

The hydrophobic fabrics used in accordance with aspects herein comprise one or more engineered zones that are integrally woven or knit, each zone having its own characteristics. For example, a first zone of the hydrophobic fabric may have a substantially planar first surface and an opposite planar second surface. A seamlessly adjacent second zone may have a substantially planar first surface and a textured opposite second surface. The first zone and second zone of the hydrophobic fabric in accordance with aspects herein are continuously or integrally woven or knitted with one another using the same set of fibers/yarns.

In accordance with further aspects herein, the hydrophobic fabrics may comprise a denier differential with the first surface of the first zone comprising a fiber/yarn having a first denier per filament (DPF), the second surface of the first zone comprising a fiber/yarn having a second DPF, the first surface of the second zone comprising a fiber/yarn having a third DPF, and the second surface of the second zone comprising a fiber/yarn having a fourth DPF. The second DPF may be greater than the first DPF, while the third DPF may be greater than the fourth DPF. The DPF may aid in the transport of moisture from a first location to a second location on the hydrophobic fabric by capillary action, moving the moisture from the yarns with greater DPF toward the yarns with lower DPF.

The textured second surface of the second zone in the hydrophobic fabric in accordance with aspects herein comprises a plurality of integrally raised structures. These integrally raised structures may have a height that can be measured along a first plane that is perpendicular to a second plane, the second plane comprising the first or second surface of the hydrophobic fabric. The integrally raised structures may be configured to transfer fluids away from a moist or wet surface, such as a wearer's skin, when the integrally raised structures come into contact with the moist or wet surface. The fluid transfer is greatly increased when a frictional force is applied in a direction that is parallel to the second plane, or in other words, by making a wiping motion in a direction that is perpendicular to the first plane.

The garments made from the hydrophobic fabric in accordance with aspects herein may comprise, for example, shorts, pants, skirts, dresses, jerseys, t-shirts, jackets, coats, vests, gloves, sweaters, jumpsuits, and the like, or any other type of garment suitable to be worn on a wearer's body. The hydrophobic fabric may be woven or knit according to specifications of characteristics of a particular garment being manufactured for strategically weaving or knitting the first zone and the second zone at intended locations corresponding to the finalized garment construct. The specifications, for example, could be specific to whether the garment is to be worn on an upper body, a lower body, etc.

An exemplary finalized garment construct, in one aspect, may comprise a lower body garment. For example, the lower body garment may comprise a pair of shorts such as basketball shorts. Basketball athletes, for example, due to their constant high paced motion, tend to sweat from the palms of their hands. Having wet or damp hands while participating in a game would be undesirable because it would potentially lower the athletes' performances by making their palms slippery and unable to get a good grip on the ball, particularly when the ball is passed to them. Typically, athletes will attempt to dry the palms of their hands by wiping them on their shorts or jerseys. However, oftentimes, the athletes' shorts or jerseys will not be very effective in removing sweat or perspiration from the athletes' palms because these garments conventionally have smooth and slippery surfaces. Additionally, after one or two wiping motions, and as physical exertion increases over time, these garments may themselves become saturated with sweat or other fluids, making them ineffective for removing sweat from the athletes' palms. Basketball shorts are just one example of the finalized garment construct contemplated herein. Other exemplary garment constructs comprise, for instance, garments for tennis players, football players, softball or baseball players, and the like.

The lower body garment comprising the hydrophobic fabric may, for example, comprise a back panel and a front panel. In exemplary aspects, the back panel may comprise two integrally woven or knit engineered zones and the front panel may comprise one woven or knit engineered zone. As described above, the first zone in the back panel may comprise substantially planar first and second surfaces, and in the second zone, one of the surfaces may be textured with a plurality of integrally woven/knit structures extending outwardly or projecting from the surface plane. In exemplary aspects, the integrally woven/knit structures may be located on an outer-facing surface of the lower body garment. The second zone in the lower body garment may be strategically placed on the back panel such that when the lower body garment is worn by a wearer, the second zone is configured to overlay a lower back and side torso area of a wearer. The size and shape of the second zone may be varied based on utility (e.g., optimal performance) as well as aesthetics.

BRIEF DESCRIPTION OF THE DRAWINGS

Aspects herein are described in detail herein with reference to the attached drawing figures, wherein.

DETAILED DESCRIPTION

Figure 1:
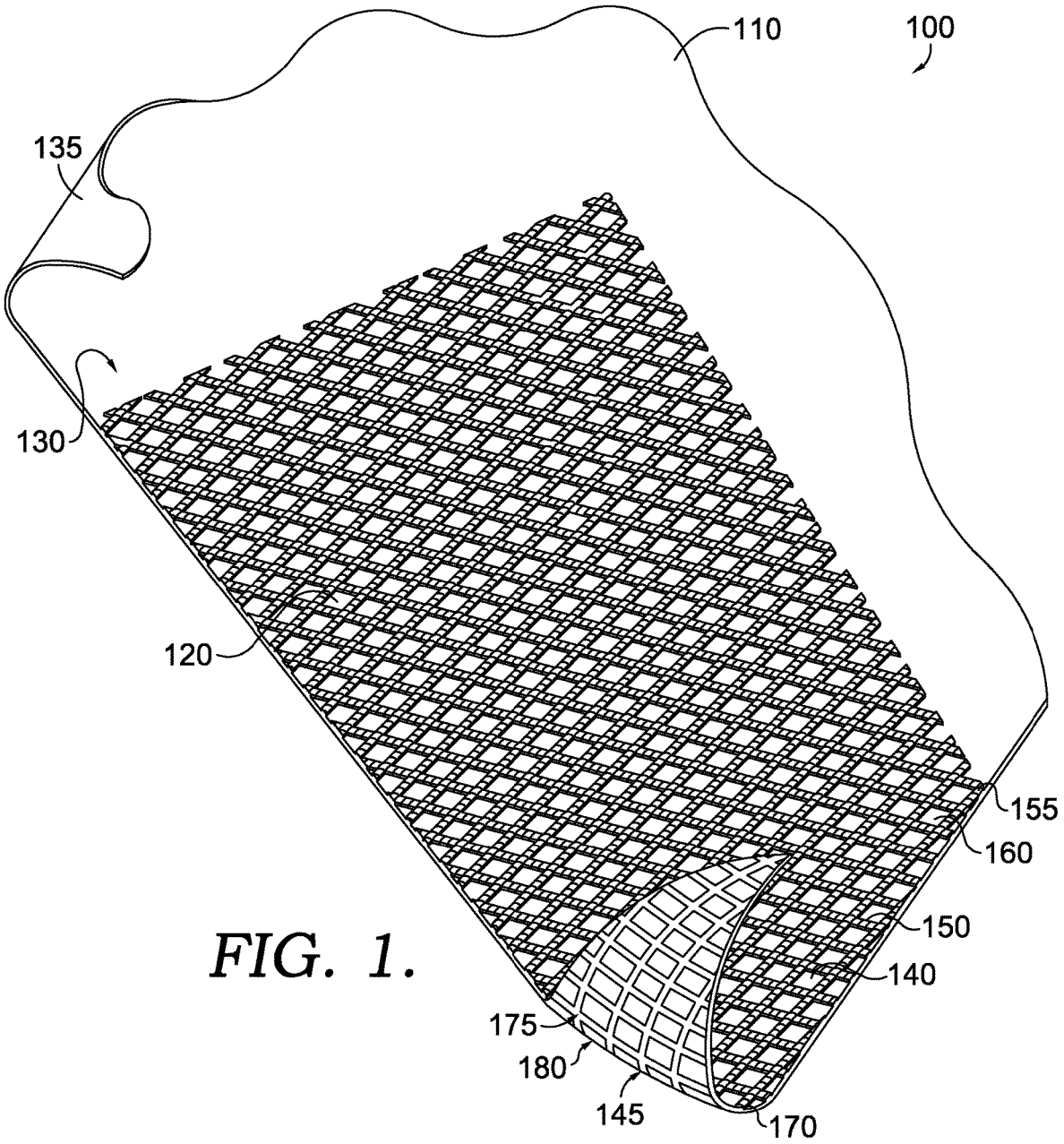
FIG. 1 depicts a piece of fabric comprising an integral wipe zone in accordance with aspects herein.

The subject matter of aspects provided herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein provide fabrics and garments comprising integrally knit or woven wipe zones. Additionally, aspects herein provide for manufacturing garments with integrally knit or woven wipe zones. In one exemplary aspect, the fabrics described herein may be formed from yarns/fibers that are inherently hydrophobic. Exemplary yarns/fibers may comprise, for example, polyester. In another exemplary aspect, the fabrics may be treated with one or more treatments to impart hydrophobic characteristics to the fabric. One such exemplary treatment may comprise a durable water repellant (DWR). One or both surfaces of the fabrics may be hydrophobic. The hydrophobicity of the hydrophobic fabrics refers to a physical property of the fabric that repels water or moisture away from their hydrophobic surface(s) and/or away from individual yarns/fibers.

In accordance with aspects herein, "integrally knit or woven" refers to two or more contiguously or continuously knit or woven fabric configurations and/or structures formed without having to stitch, adhere, glue, or otherwise piece together two or more knit or woven fabrics with different configurations and/or structures. As such, the contiguously knit or woven configurations and/or structures are seamlessly adjacent to one another. The two or more continuously knit or woven fabric configurations and/or structures are engineered for providing the resulting fabric with at least two different properties within the same knit or woven fabric piece. In other words, the fabric configurations and/or structures engineered for providing the fabric with at least two different properties within the same knit or woven fabric piece are knit or woven side-by-side and comprise a single fabric layer. To put it yet another way, the different properties are achieved within the same fabric without having to layer different fabrics having the different properties on top of one another or adjacent to one another.

As used throughout this disclosure, the term "zone" is used to refer to each individual knit or woven fabric configuration within the same knit or woven fabric piece. And, as used throughout this disclosure, the term "wipe zone" refers to a "zone" having engineered "integrally knit or woven" raised structures capable of efficiently wiping moisture away from a wet surface.

Figure 6B:
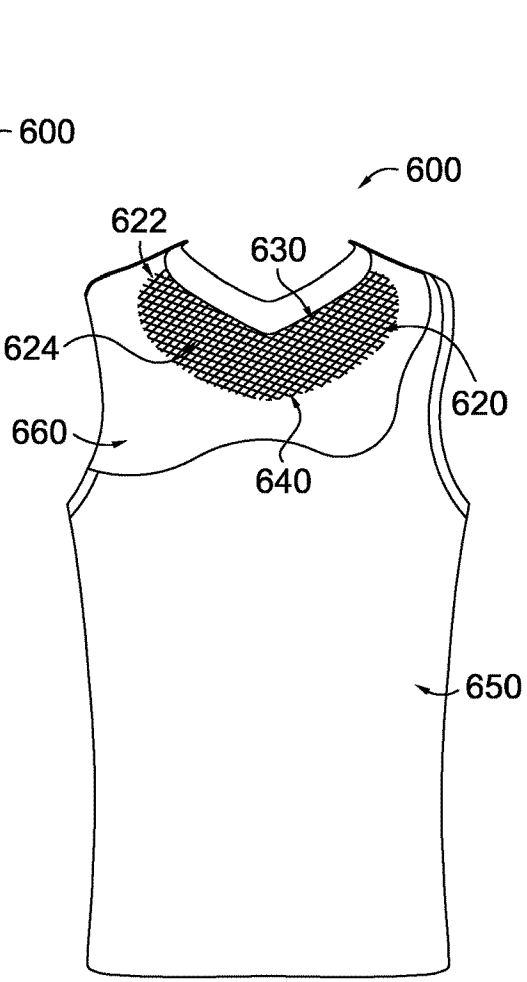
FIGS. 6A and 6B depict different views of a different upper body garment in accordance with aspects herein.
Figure 6A:
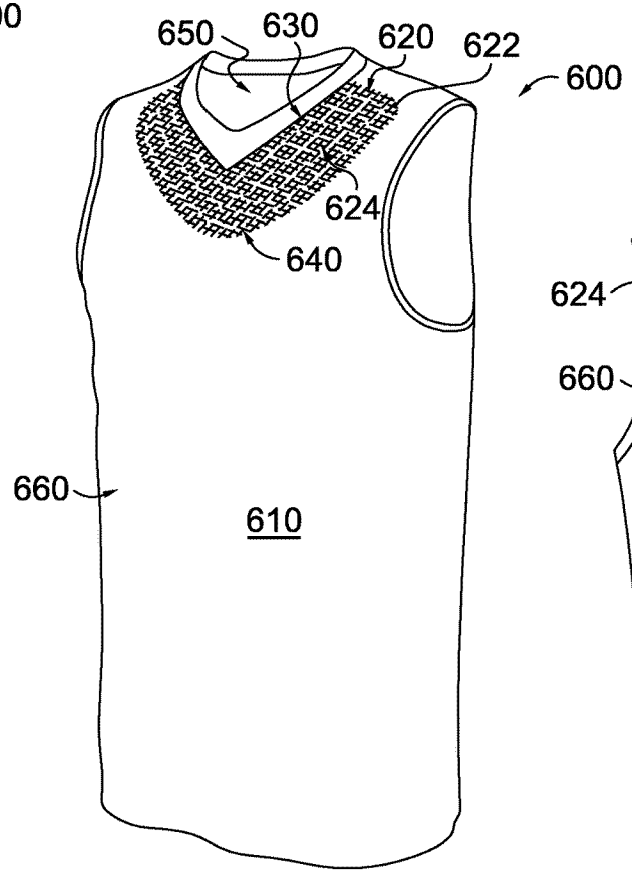
Figure 5:
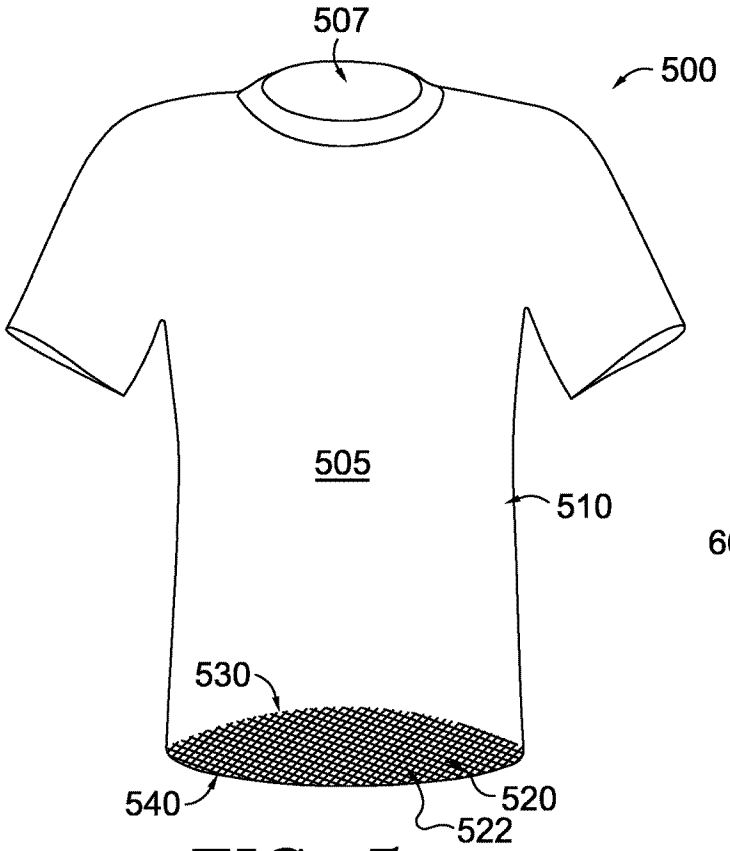
FIG. 5 depicts an upper body garment in accordance with aspects herein.

Turning now to FIG. 1, FIG. 1 depicts a close up view of a piece of a hydrophobic fabric 100 in accordance with aspects herein. As depicted, the hydrophobic fabric 100 comprises a first zone 110 and a second zone 120, wherein the second zone 120 forms an integral wipe zone. The hydrophobic fabric 100 in accordance with aspects herein may be knit or woven with a configuration having functionality in the final product. For example, the fabric in accordance with aspects herein may be a woven jacquard, such as an engineered pattern woven jacquard. For example, the hydrophobic fabric 100 may be specifically woven/knit in a configuration usable for the construction of a lower body garment (as shown in FIGS. 2A to 2D). In another example, the hydrophobic fabric 100 may be woven/knit in a configuration usable for the construction of an upper body garment (as shown in FIGS. 5 and 6A-6B). In other words, the hydrophobic fabric 100 may be knit or woven with wipe zones (e.g., second zone 120) that are shaped and sized for a particular garment or other product to be manufactured, placing the wipe zones at predetermined locations of the hydrophobic fabric 100, corresponding with the final location for the wipe zones on the final constructed garment or other product. Alternatively, a pre-woven/knit hydrophobic fabric 100 may be cut into appropriate product panels, placing the first zone 110 and the second zone 120 at desired locations in the constructed product.

In accordance with aspects herein, one or both surfaces of the woven/knit hydrophobic fabric 100 may be hydrophobic and may comprise at least two different zones 110 and 120, as shown in FIG. 1. For example, the first zone 110 may comprise a first hydrophobic inner face 135 and a first hydrophobic outer face 130, where both the first hydrophobic inner face 135 and the first hydrophobic outer face 130 have a planar surface and are substantially planar with respect to one another. A second zone 120 may comprise a second hydrophobic inner face 145 and a second hydrophobic outer face 140, where the second hydrophobic inner face 145 also has a planar surface. The second hydrophobic outer face 140, on the other hand, comprises a plurality of integrally raised structures 150 extending outward from the second hydrophobic outer face 140. In exemplary aspects, the integrally raised structures 150 may further comprise micro-channels 170 to improve and speed up moisture transport through the integrally raised structures 150. In the second zone 120, the integrally raised structures 150 may comprise interconnected ridges 155 with valleys 160 located between the interconnected ridges 155. The second hydrophobic inner face 145 of the second zone 120, although substantially planar, may have shadow structures 175 corresponding to the interconnected ridges 155 and valleys 180 corresponding to the valleys 160. The second zone 120 is configured to function as an integral wipe zone for the fabrics in accordance with aspects herein.

As described, the hydrophobic fabrics in accordance with aspects herein may comprise inherently hydrophobic yarns/fibers (e.g., polyester, nylon), or natural yarns/fibers (e.g., cotton, hemp, silk) treated with a hydrophobic coating. Alternatively, a combination of natural and synthetic yarns may be used to construct the fabrics in accordance with aspects herein, and the formed fabrics may be treated with a hydrophobic coating(s) on one or both surfaces of the fabrics. Additionally, the fabrics may be stretch woven or knit, or in other words, the fabrics may be formed with added elasticity by interweaving or interknitting elastic yarns/fibers (e.g., elastane.) For example, the hydrophobic fabrics may contain at least 2% of elastic yarns/fibers. In aspects herein, the fabrics may contain between 2% and 25% of elastic yarns/fibers. For example, the fabrics may comprise up to 40% elastic fibers and up to 60% synthetic or natural fibers, or a combination of both, the fabrics may comprise up to 30% elastic fibers and up to 70% synthetic or natural fibers, or a combination of both, the fabrics may comprise up to 20% elastic fibers and up to 80% synthetic or natural fibers, or a combination of both, or the fabrics may comprise up to 10% elastic fibers and up to 90% synthetic or natural fibers, or a combination of both. Alternatively, the fabrics may comprise between 2% and 25% elastic fibers and between 98% and 75% hydrophobic yarns/fibers or the like (such as other inherently hydrophobic fibers or natural fibers treated with a hydrophobic coating), between 5% and 15% elastic fibers and between 95% and 85% hydrophobic yarns/fibers or the like. For example, the fabrics in accordance with aspects herein may comprise 10% elastane or other elastic fibers and 90% polyester or nylon, or a combination of polyester and nylon.

As described above, the hydrophobic fabric 100 in accordance with aspects herein comprises at least two different integrally woven/knit and seamlessly adjacent zones 110 and 120, the adjacent zones being configured differently from each other. The hydrophobic fabric 100 may be integrally woven/knit with the at least two adjacent zones 110 and 120 having different configurations by changing the stitch at locations where the integrally raised structures 150 are presented. Additionally or alternatively, the yarns/fibers may be switched or additional yarns/fibers may be introduced at the locations where the integrally raised structures 150 are presented during the weaving or knitting of the hydrophobic fabric 100. In yet a different example, the integrally raised structures 150 may be provided by embroidery methods, such as by embroidering the integrally raised structures 150 into suitable patterns with suitable yarns/fibers. The yarns/fibers forming the integrally raised structures may have a DPF that is greater than the DPF of the rest of the yarns/fibers forming the rest of the fabric surface on which the integrally raised structures 150 are provided. Alternatively, the yarns/fibers forming the integrally raised structures 150 may have a DPF that is equal to or greater than the DPF of the yarns/fibers forming the substantially planar first hydrophobic inner face 135 and the opposite substantially planar first hydrophobic outer face 130, not comprising the integrally raised structures 150.

Figure 2B:
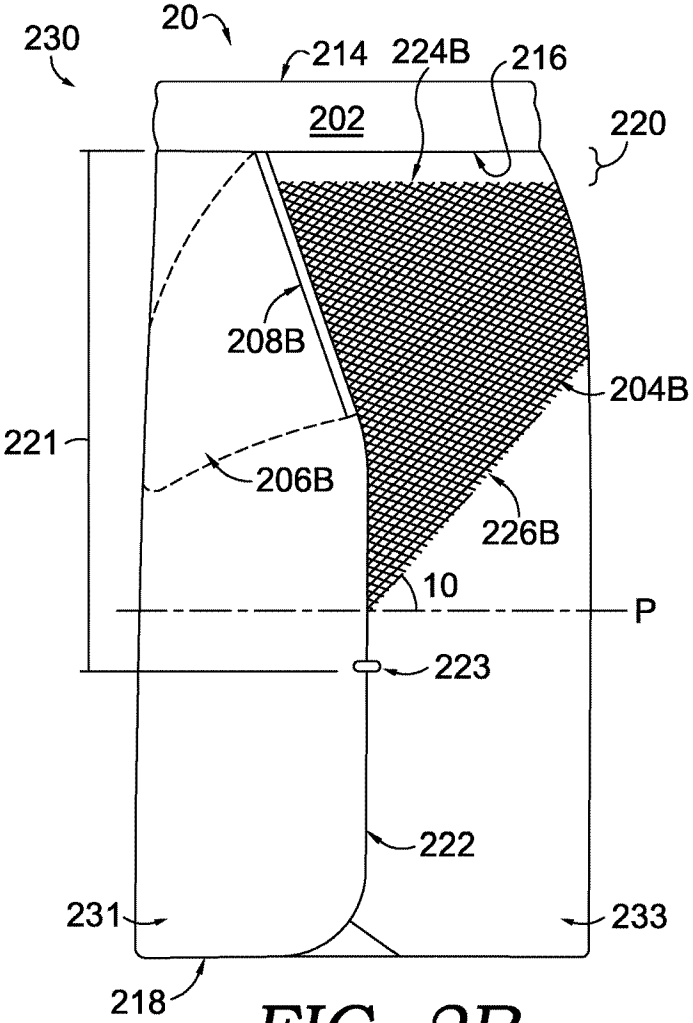
FIGS. 2A to 2D depict different perspective views of an exemplary lower body garment comprising the hydrophobic fabric in accordance with aspects herein.
Figure 2A:
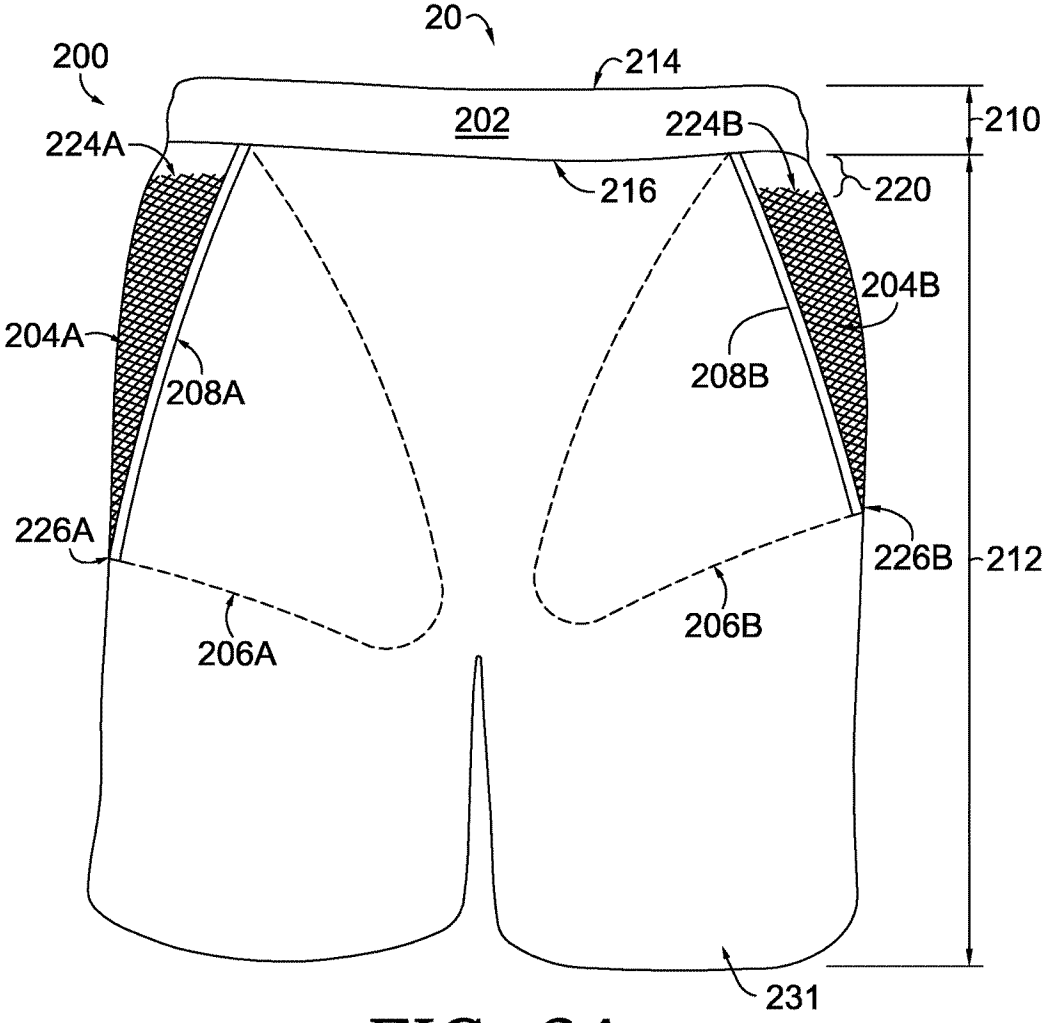

FIGS. 2A to 2D depict different perspective views of an exemplary lower body garment 20 comprising the hydrophobic fabric 100 in accordance with aspects herein. As shown in the front view 200 of the lower body garment 20 depicted in FIG. 2A, the lower body garment 20 comprises a front panel 231 and a back panel 233 (FIGS. 2B and 2C) joined by two lateral seams forming left seam line 222 and an opposite right seam line (not shown). The front panel 231 comprises a first hydrophobic fabric having a first outer face and a first inner face that are substantially planar, such as the first zone 110 of the hydrophobic fabric 100 shown in FIG. 1, above. The lower body garment 20 in FIG. 2A comprises an optional waistband 202. The waistband 202 has a thickness 210 measured from a waistband top edge 214 to a waistband bottom edge 216. In FIG. 2A, the lower body garment 20 shown is a pair of shorts having an overall length 212 measured from the waistband bottom edge 216 to the lower body garment bottom edge 218. Although the lower body garment 20 shown in FIGS. 2A-2D is depicted as a pair of knee length shorts, it is contemplated herein that the lower body garment 20 may be in the form of shorter shorts, long pants, three-quarter pants, Capri-pants, mini-skirt, knee-length skirt, long skirt, skorts of different lengths, and the like, without departing from aspects herein. In exemplary aspects, the lower body garment 20 comprises optional pockets 206A and 206B with pocket openings 208A and 208B respectively that are adjacent to an upper portion of the left seam line 222 and opposite right seam line.

The lower body garment 20 shown in FIGS. 2A to 2D comprises the at least one front panel 231 and the at least one back panel 233. As shown in FIG. 2B, the front panel 231 and back panel 233 may be sewn or joined together at the left seam line 222 and the corresponding right seam line on the opposite side (not shown) to form the lower body garment 20. In exemplary aspects, the left seam line 222 may extend from the waistband bottom edge 216 to the lower body garment 20 bottom edge 218. In aspects, the left seam line 222 extends a distance 221 from the waistband bottom edge 216 to a stitch point 223 that sits at least 1/10 of a distance, measured from the waistband bottom edge 216 to the lower body garment 20 bottom edge 218, above the lower body garment 20 bottom edge 218. The shorter seam line may allow for an increased freedom of movement for the legs of a wearer of the exemplary lower body garment 20 shown in FIGS. 2A to 2D, when the lower body garment 20 is worn.

The lower body garment back panel 233 further comprises wipe zone(s) 204A and 204B, which would correspond to the second zone 120 in the woven/knit hydrophobic fabric 100 of FIG. 1, where the second zone 120 comprises the plurality of integrally raised structures 150 on the second hydrophobic outer face 140 of the knit/woven hydrophobic fabric 100. The wipe zone(s) 204A and 204B may extend from a predetermined area of the lower body garment 20 up to the left seam line 222 and corresponding right seam line that may also be aligned with the pocket openings 208A and 208B. The wipe zone(s) 204A and 204B may be configured to overlay at least a portion of the lower back torso area of a wearer when the lower body garment 20 is in an as-worn configuration, as shown in FIG. 2D. For example, the predetermined area may extend from a hypothetical vertical midline (not shown) that bisects the back panel into equal right and left halves up to the left seam line 222 as shown in the lateral view 230 of the lower body garment 20 shown in FIG. 2B, and corresponding right seam line (not shown). The wipe zone(s) 204A and 204B may have a shape and size that is both suitable for its intended purpose and at the same time is aesthetically appealing.

In exemplary aspects, the wipe zones 204A and 204B may be present in only the back panel 233 of the lower body garment 20 and may take up at least 5% of the total area of the back panel 233 of the lower body garment 20 shown in FIGS. 2A-2D. In additional exemplary aspects, the wipe zones 204A and 204B may take up at least 10% of the back panel 233 of the lower body garment 20 shown in FIGS. 2A-2D. In other examples, the front panel 231 of the lower body garment 20 may also comprise integral wipe zones taking up at least 5% of the total area of the front panel 231 of the lower body garment 20 (not shown.)

Although the lower body garment 20 in FIGS. 2A-2D is depicted as comprising a front panel 231 and a back panel 233, one of ordinary skill in the art will recognize that the number of panels needed to construct the lower body garment 20 may change depending on the type of construction method used and the style of lower body garment being constructed. For example, the lower body garment 20 may be circular knit in a single piece when the fabric is knit to have no seam lines, or flat knit or woven as a single piece to have a single seam line. Alternatively, the lower body garment 20 may be constructed from three, four, five, etc., number of panels with three, four, five, etc., number of seam lines. This concept, although described in the context of a lower body garment, is also applicable to any type of garment or object being constructed.

Figure 2C:
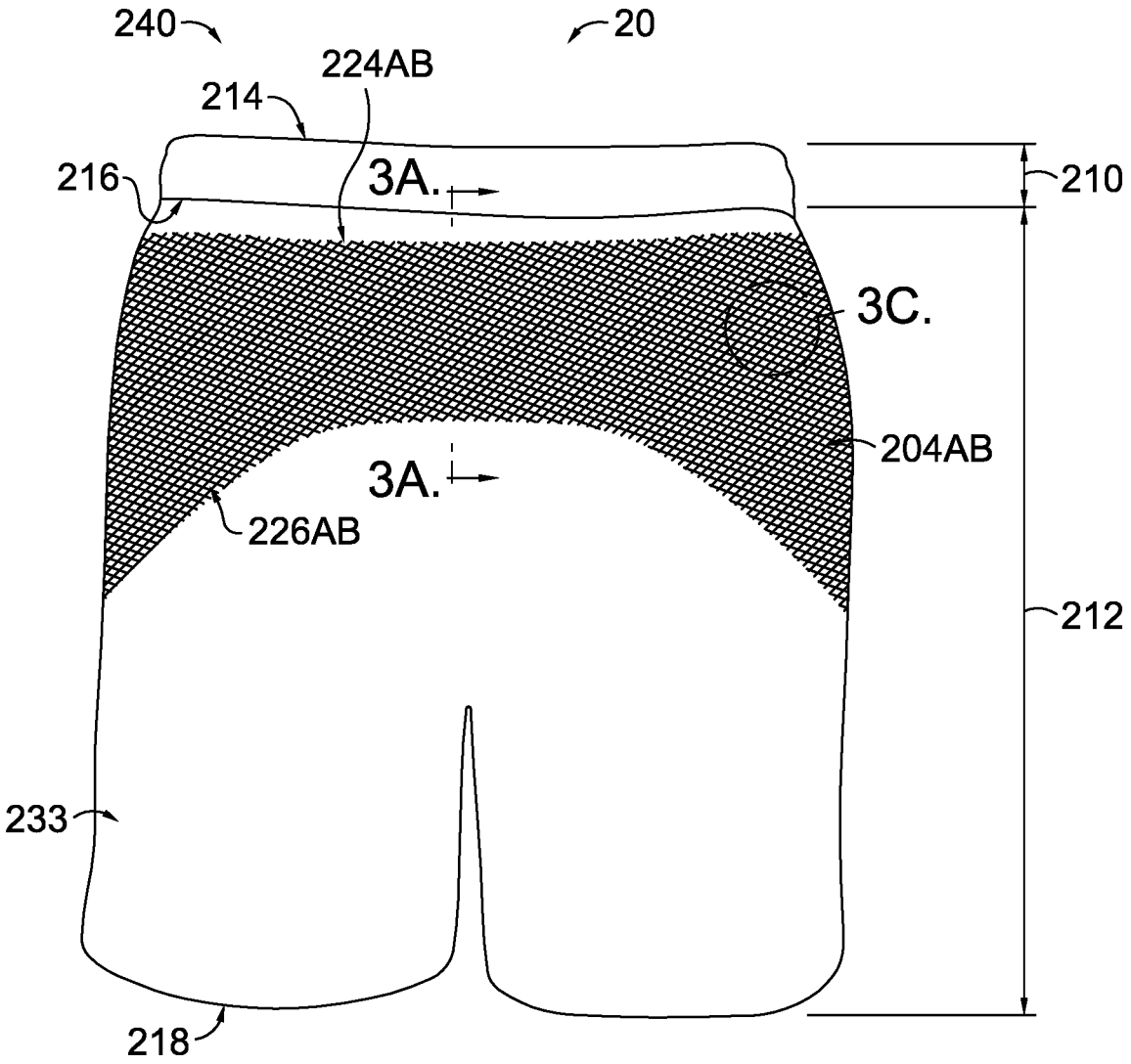
Figure 2D:
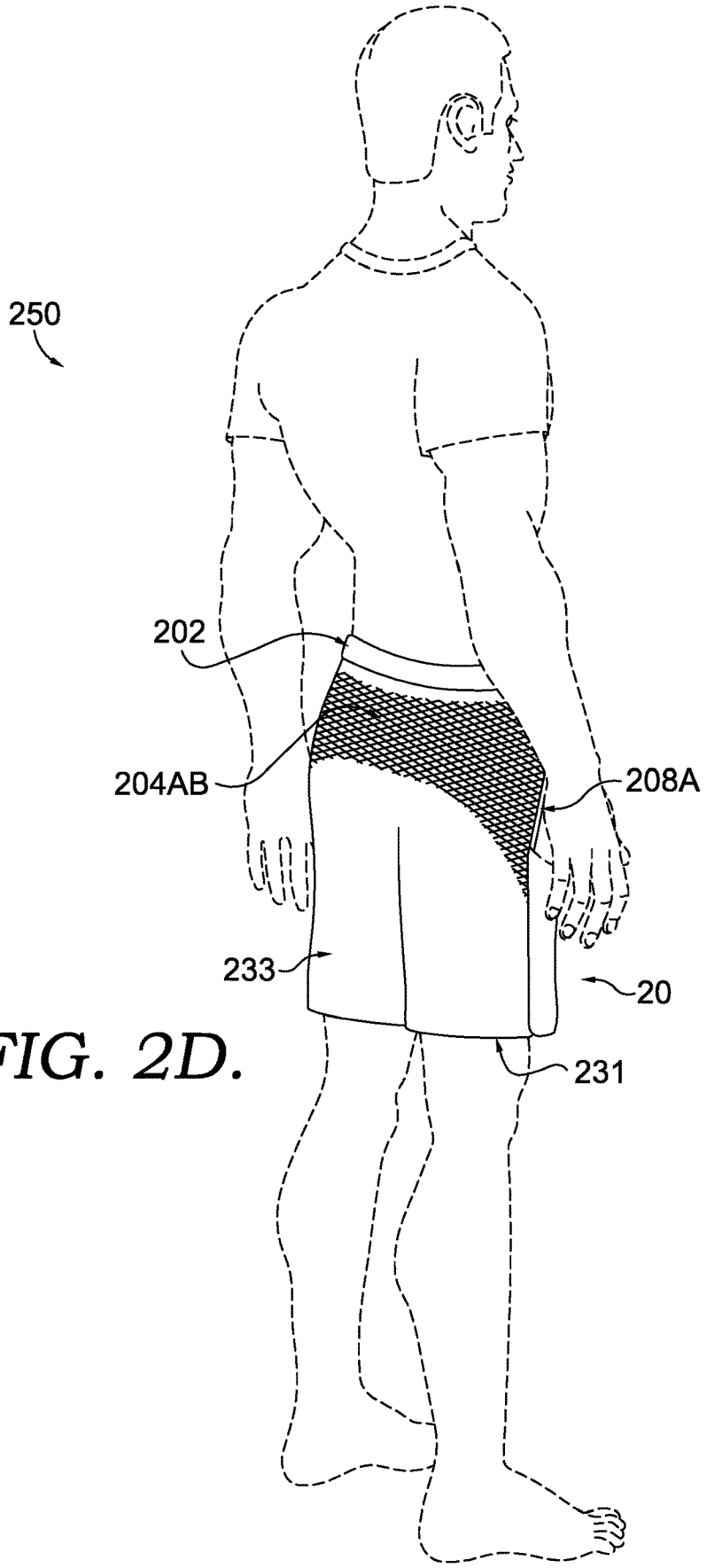

With particular respect to FIG. 2C, the wipe zones 204A and 204B may comprise a single wipe zone 204AB that is configured to extend across the back panel 233, as shown in back view 240, at an area that is adapted to overlay a lower back torso area of a wearer when the lower body garment 20 is worn. In exemplary aspects, the wipe zone 204AB may be wider closer to pocket openings 208A and 208B and taper toward a vertical midline of the back panel 233, as shown in the back view 240 of FIG. 2C. For example, upper edges 224A and 224B of wipe zones 204A and 204B, or upper edge 224AB of wipe zone 204AB may be abut waistband bottom edge 216, or may lie a uniform distance 220 away from waistband bottom edge 216 such that the upper edges 224A and 224B, or upper edge 224AB is parallel to the waistband bottom edge 216. While lower edges 226A and 226B of wipe zones 204A and 204B, or lower edge 226AB of wipe zone 204AB, may taper from left seam line 222 at an angle 10 measured in reference to a perpendicular plane P relative to the lower body garment 20 (as shown in FIG. 2B). Alternatively, the wipe zone(s) 224AB may comprise a uniform width throughout (not shown.)

Figure 3A:
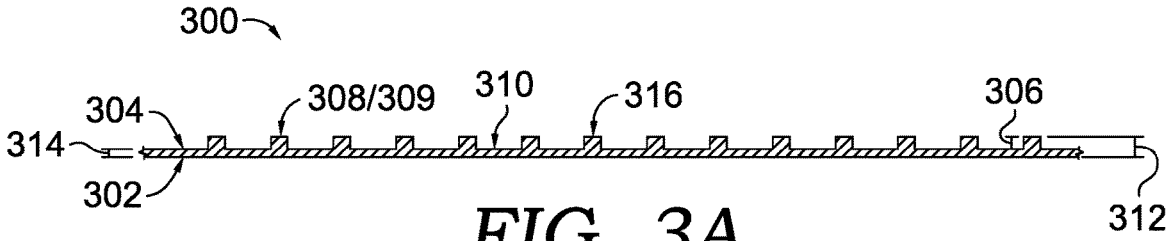
FIG. 3A depicts a cross sectional view of the garment according to FIG. 2C, along the line 3A-3A in accordance with aspects herein.

The integrally woven/knit wipe zones in accordance with aspects herein will be described in greater detail with reference to FIGS. 3A to 3C. FIG. 3A depicts a portion of a cross-section of back panel 233 depicted in FIG. 2C of lower body garment 20, along the cut line 3A-3A and is referenced generally by the numeral 300. As seen in FIG. 3A, the wipe zone(s) 224AB comprises a first (inner) surface 302 and a second (outer) surface 304. The first surface 302 may be substantially planar when compared to the second surface 304. The second surface 304 comprises a plurality of integrally raised structures 308 extending outward from the second surface 304. The integrally raised structures 308 may be arranged in any suitable pattern to provide the desired moisture removal effect, while at the same time providing a desired visual effect. For example, the integral wipe zones may comprise an array of interconnected ridges 155 and valleys 160, as shown in FIG. 1. Alternatively, as shown in FIGS. 4A to 4B, different configurations 410 and 420 for the wipe zones may be possible. For instance, the integrally raised structures may comprise an array of two or more separate different shapes such as 412 and 414 as shown in FIG. 4A, or 422 and 424 as shown in FIG. 4B, between valleys 416 and 426, respectively. These are only exemplary configurations and are illustrative and not limiting. Other configurations may, for example, include patterns of team logos, brand logos, or any other shape deemed suitable in accordance with aspects herein.

Figure 3B:
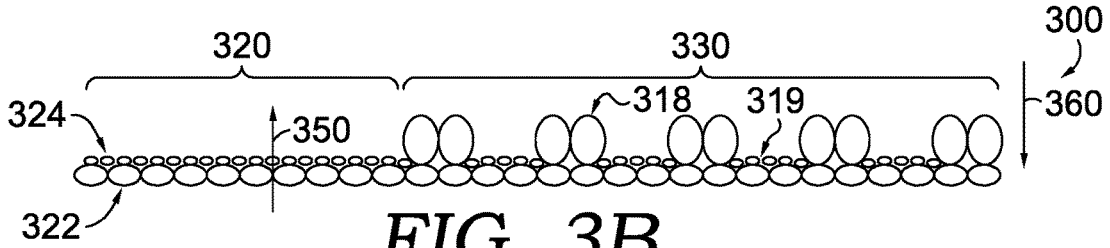
FIG. 3B depicts a close up view of FIG. 3A in accordance with aspects herein.
Figure 4A:
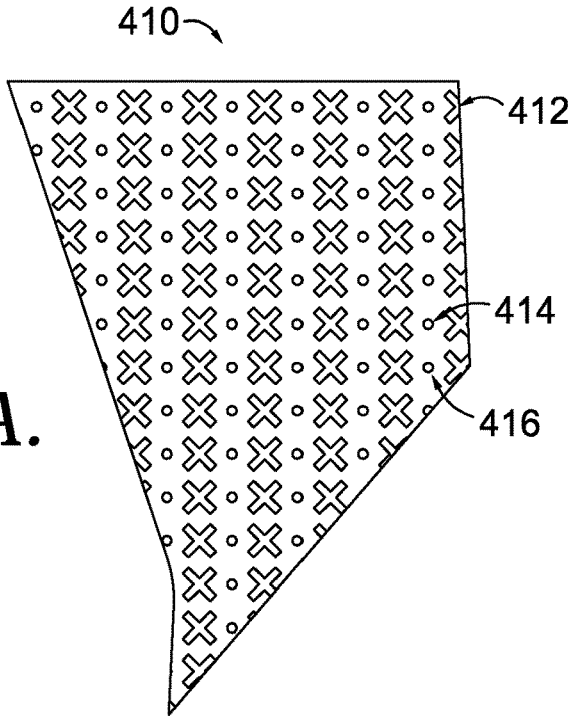
FIGS. 4A and 4B depict different exemplary wipe zone configurations in accordance with aspects herein.
Figure 4B:
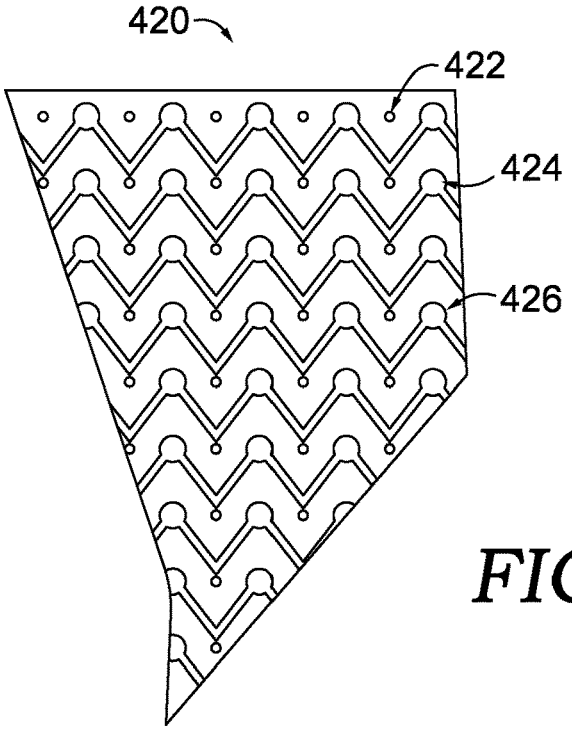

Referring collectively back to FIGS. 3A and 3B, the hydrophobic fabric may comprise a thickness 314 in a first zone 320, measured as the distance between the first surface 302 to the second surface 304. The integrally raised structures 308 may have a predetermined height 306 measured from the second surface 304 to apexes 316 of the integrally raised structures 308. Therefore, an overall thickness 312 in a second zone 330 may be obtained by adding the thickness 314 of the hydrophobic fabric in the first zone 320 plus the predetermined height 306 of the integrally raised structures 308. As seen in FIG. 3A, the integrally raised structures 308 may comprise apexes 316 that form ridges 309, with valleys 310 at the bases of the ridges 309 or integrally raised structures 308.

As described above in reference to FIG. 1, both the first surface 302 and the second surface 304 of the fabric of, for example, the lower-body garment 20 may be hydrophobic. Therefore, the lower body garment 20 in accordance with aspects herein will have a tendency to stay dry by repelling moisture and letting any water-based liquids, such as water and sweat, slide off the surfaces of the garment. For example, FIG. 3B depicts a close up view of FIG. 3A, where moisture transport from the first (interior) surface 322 (corresponding to first surface 302 in FIG. 3A) of the first zone 320 to the second (outer) surface 324 (corresponding to second surface 304 in FIG. 3A) of the first zone 320 of the fabric 300 may be accomplished by providing a denier differential for the fabric 300 in accordance with aspects herein. For instance, in order to encourage moisture transport away from a wearer's skin when the garment is worn, the yarns/fibers provided for the first surface 322 at the first zone 320 may have a greater DPF than the yarns/fibers provided for the second surface 324. When the yarns/fibers of the first surface 322 contact the wearer's skin when the garment is worn, the greater DPF of the first surface 322 will cause the absorption of moisture away from the wearer's skin toward the second surface 324 by capillary action. Subsequently, the moisture gathered on the second surface 324 with a smaller DPF may slide off the fabric through the natural pull of gravity.

On the other hand, at the second zone 330, where integrally raised structures 318 are provided, the DPF of yarns/fibers forming the integrally raised structures 318 may be greater than the DPF of the opposite surface 322 of the fabric 300. The integrally raised structures 318 may be formed of hydrophobic yarns/fibers. Therefore, as the integrally raised structures 318 are used to wipe moisture away from a moist or wet surface (e.g., a wearer's skin), the moisture will travel from the integrally raised structures 318 toward the second surface 324 into the valleys 319 formed between the integrally raised structures 318. The second surface 324 comprises yarns/fibers having a smaller DPF than the yarns/fibers forming the integrally raised structures 318 and the DPF forming the surface 322 of the fabric 300 (as shown.) Therefore, as moisture is gathered in the valleys 319, the moisture will have a tendency to slide off the overall second surface 324 of the fabric 300 without it being absorbed through the fabric 300.

Moisture tends to be absorbed into the yarns/fibers with the greater DPF and is carried away by capillary action to the surface with the smaller DPF. Thus, moisture will flow in one direction 350 in the first zone 320 and in an opposite direction 360 in the second zone 330, and as such, the moisture that is gathered on the second surface 324 and valleys 319 will be readily eliminated by letting it "drip" as it is pulled by the force of gravity.

Figure 3C:
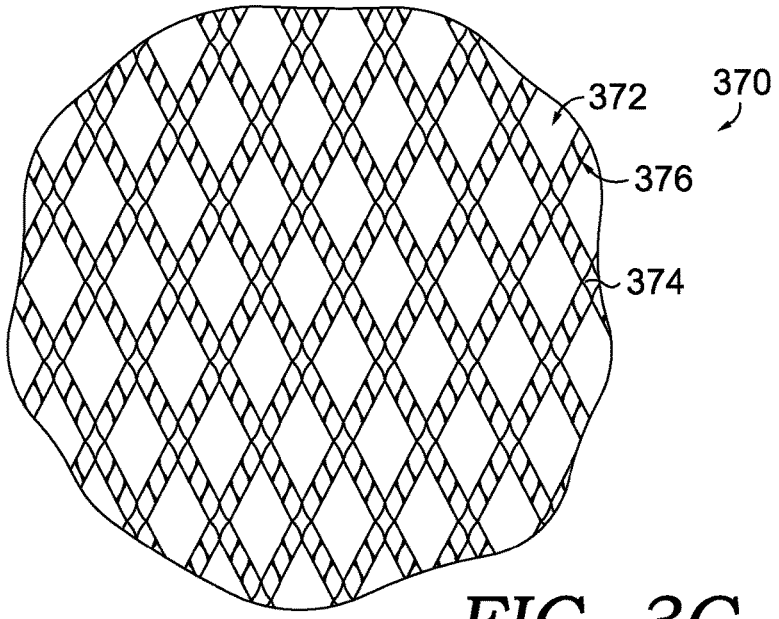
FIG. 3C depicts a blow up view of the area 3C in FIG. 2C in accordance with aspects herein.

Furthermore, FIG. 3C depicts a close-up of the area 370 designated as 3C in FIG. 2C of the wipe zone 204AB. As shown, the wipe zone 204AB comprises an array or pattern of integrally raised structures 374 with valleys 372 formed between the arrays of integrally raised structures 374. Further, the integrally raised structures 374 may comprise micro-channels 376 to further aid in speeding up the moisture transport away from a moist/wet surface (e.g., a user's skin) when the wipe zone 204AB is used to wipe away the moisture from the moist/wet surface. For example, the micro-channels 376 create passageways for the moisture gathering first at the apexes 316 to efficiently travel toward the valleys 310 where the moisture may be allowed to accumulate to a sufficient amount that is susceptible to the pull of gravity, thereby causing the moisture to slide off the outer surfaces 304/324 shown in FIGS. 3A and 3B.

FIG. 2D depicts the lower body garment 20 described in FIGS. 2A to 2C in an as-worn configuration 250. As it can be seen in the as-worn configuration 250, the wipe zone 204AB is configured to overlay a lower back torso of a wearer, where it is readily accessible to the athlete (wearer) for quickly and readily wiping his/her palms with a generally downward or sideways motion, when needed. In particular, in sports such as basketball, baseball, or tennis where hands are heavily involved, the discomfort of having sweaty or wet hands may be readily alleviated by providing a wipe zone on the garment itself. Thereby, the performance of the athlete may also be readily improved by alleviating the slippery nature of sweaty or wet hands, by allowing the athlete to have a better control of the ball, bat, or racquet, depending on the sport or position being played.

FIG. 5 depicts an exemplary upper body garment 500 constructed from the hydrophobic fabric in accordance with aspects herein. As background, when a person exerts herself physically, she will most likely sweat from her head. As the physical exertion continues and/or becomes more intense, the sweat from her head will most likely increase and start to drip on her forehead into her face, including into her eyes. This creates great discomfort. Oftentimes, a person who is engaged in a physically demanding activity will carry a towel with her. However, having to carry a towel around is often cumbersome, and once the towel becomes saturated, the towel will become ineffective for its intended purpose. If a towel is unavailable, a person will impulsively take the bottom front portion of her upper body garment and use this bottom front portion to wipe away the sweat on her face.

Taking this motion into account, the garment 500 may be an upper body garment with at least a front panel 505 and a back panel 507, the front panel 505 having a first zone 510 and a seamlessly adjacent second zone 520 on the surface that is opposite (exposed to the external environment) from the skin-contacting surface of the garment 500. The second zone 520 is located at a bottom portion of the front panel 505 near a bottom edge of the garment 500 and comprises integrally woven or knit raised structures 522 similar to those described above in reference to the lower body garment 20 depicted in FIGS. 2A-2D. The second zone 520 may extend from a first edge 530 to a second edge 540. The size and shape of the second zone 520 may be varied according to the functionality and aesthetic appeal desired for the particular garment 500. Although the garment 500 in FIG. 5 is depicted as a short sleeved crew neck t-shirt, it is contemplated herein that the lower body garment 500 may be in the form of a V-neck sleeveless t-shirt, long-sleeved V-necked or crew necked t-shirt, a short or long sleeved hoodie, a short or long sleeved sweater, a thin, medium, or thick jacket, a tank top, a jersey tank top, and the like, without departing from aspects herein.

FIGS. 6A and 6B depict a different exemplary upper body garment 600 in the form of a jersey, in accordance with aspects herein. When sweat or another aqueous solution drips into the face of a person, another impulsive motion to wipe away the moisture from his/her face is by taking a front panel 660 of the upper body garment 600 over his/her head and wiping his/her head on an interior (skin-contacting) aspect of the front panel 660. As such, the upper body garment 600 in accordance with aspects herein comprises a first zone 610 and a seamlessly adjacent second zone 620, wherein the second zone 620 is located on an upper interior portion 624 (skin-contacting surface when worn) of the front panel 660 of the upper body garment 600, as shown in FIGS. 6A and 6B, where the integrally raised structures 622 are shown in shadow form in FIG. 6A, to represent that they are internal and may not be actually visible on the outer surface. In a different aspect, a back panel 650 of the upper body garment 600 may also comprise integrally raised structures 622 at, for example, shoulder and/or upper back interior portions (not shown), for providing a wiping functionality with the natural shifting of the upper body garment 600 on the wearer's body when the wearer is undergoing physical exertion (such as in a game of basketball).

The second zone 620 comprising the integrally raised structures 622, may extend from a first edge 630 to a second edge 640. The size and shape of the second zone 620 may be configured according to the functionality and aesthetic appeal desired for the particular upper body garment 600. Since the integrally raised structures 622 are internal to the upper body garment 600, the aesthetic appeal may play a lesser role than when the integrally raised structures 622 are external to the upper body garment, as in the upper body garment 500 in FIG. 5.

Figure 7:
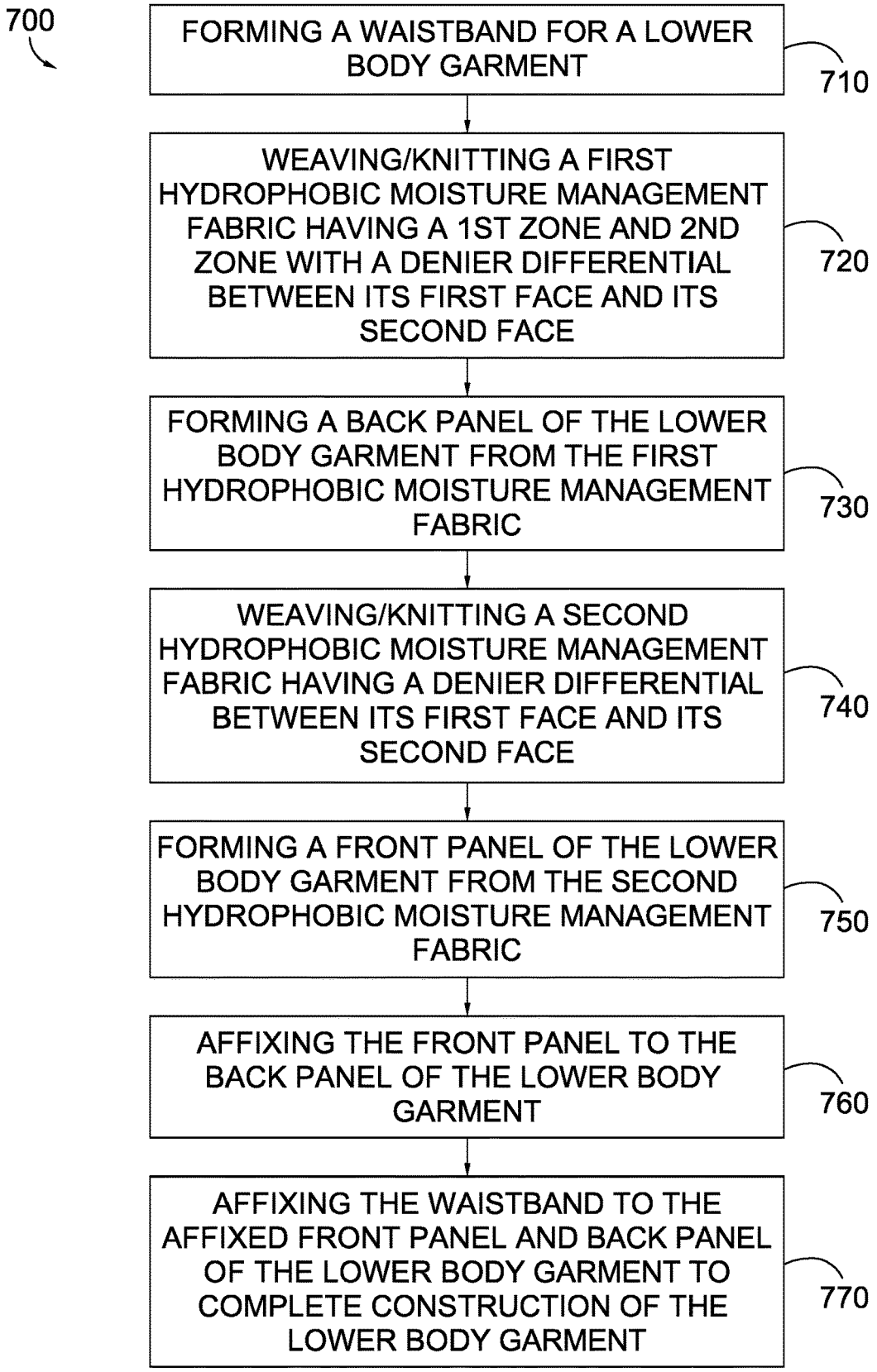
FIG. 7 depicts an exemplary method for manufacturing an exemplary garment in accordance with aspects herein.

FIG. 7 depicts an exemplary method 700 for manufacturing a lower body garment, such as the exemplary lower body garment 20 shown in FIGS. 2A to 2D. For example, the lower body garment 20 shown in FIGS. 2A to 2D may be manufactured by forming a waistband for the lower body garment 20 at block 710. The waistband may be made to be entirely elastic or stiff, or alternatively, the waistband may be manufactured from a combination of elastic and non-elastic materials. In exemplary aspects, step 710 may comprise an optional step. Next, a first hydrophobic moisture management fabric may be woven or knit at block 720, the first hydrophobic moisture management fabric comprising a first zone and a second zone with an optional denier differential between its first face and its second face. Then, as described at block 730, a back panel for the lower body garment 20 may be formed from the first hydrophobic moisture management fabric. Then, as described at block 740, a second hydrophobic moisture management fabric having an optional denier differential between its first face and its second face may be woven or knit, from which a front panel of the lower body garment 20 may be formed at block 750. Once the front panel and the back panel of the lower body garment 20 are formed, the front panel and the back panel may be affixed to each other, as described at block 760. Finally, the waistband formed in block 710 may also be affixed to the affixed front panel and back panel of the lower body garment 20 to complete construction of the lower body garment 20. It should be understood that the method presented in FIG. 7 is only exemplary and non-limiting. The different steps described may or may not follow the order of events, as described.

Figure 8:
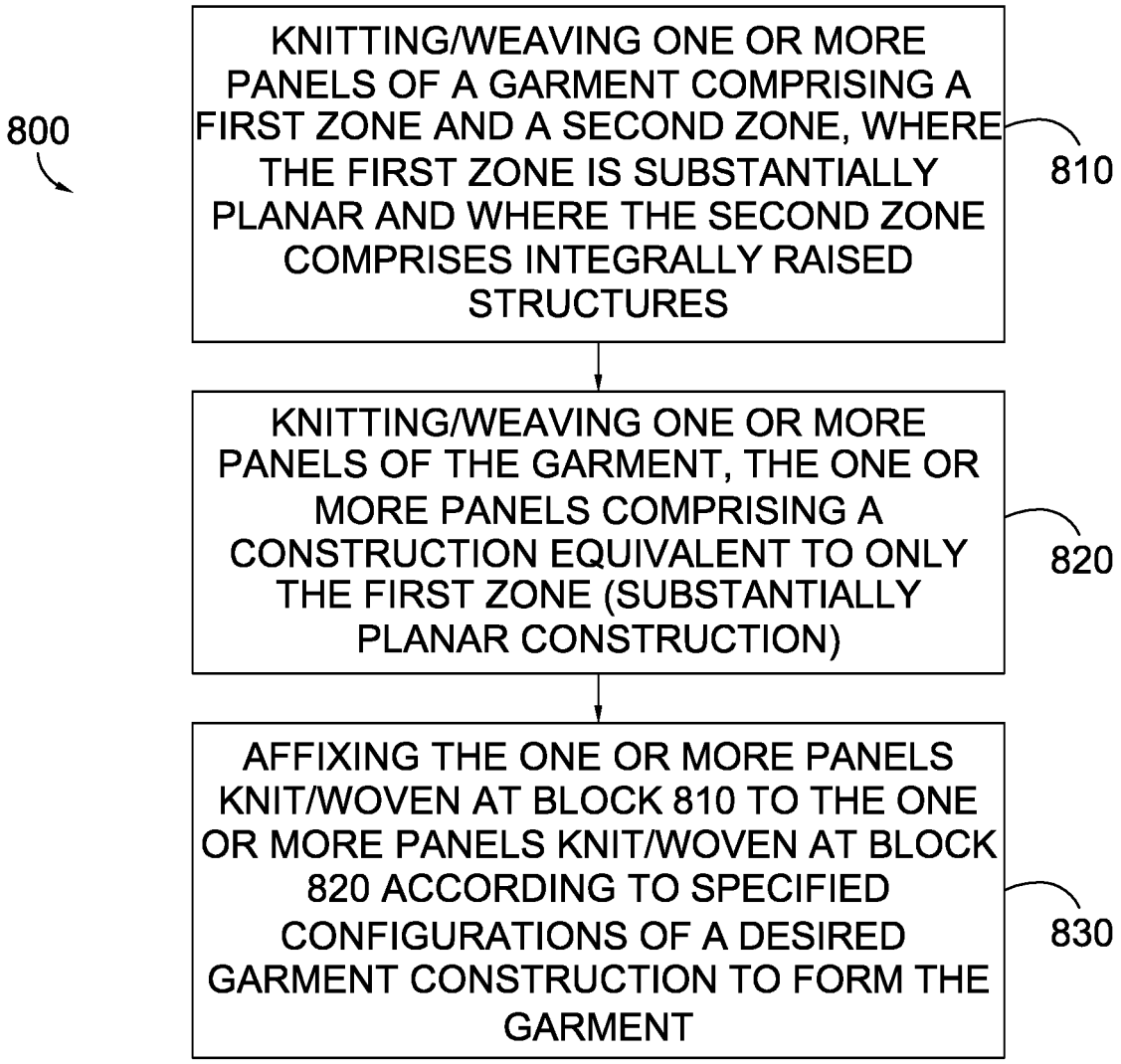
FIG. 8 depicts an exemplary method for manufacturing garments in accordance to aspects herein.

FIG. 8 depicts an exemplary method 800 for manufacturing garments in accordance to aspects herein. First, one or more panels of a garment comprising a first zone and a second zone, where the first zone comprises a substantially planar construction, and where the second zone comprises integrally raised structures, may be knit/woven at block 810, such as the first zone 110 and the second zone 120 shown in FIG. 1. The one or more panels knit/woven at block 810 may be knit/woven from inherently hydrophobic materials, or alternatively, the panels may be treated with hydrophobic coating material(s) after the panels have been knit/woven. Then, as described at block 820, one or more panels of the garment comprising a construction equivalent to only the first zone (substantially planar construction) may be knit or woven. Finally, as described at block 830, the one or more panels knit or woven at block 810 may be affixed to the one or more panels knit or woven at block 820 according to specified configurations of a desired garment construction to form the garment.

From the foregoing, it will be seen that aspects described herein are well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A single layer hydrophobic fabric comprising:

a first zone comprising:

a first face and a second face opposite the first face, wherein the first face and the second face have substantially planar surfaces and are hydrophobic; and a second zone seamlessly adjacent to the first zone in a side by side relationship, the second zone comprising:

a third face and a fourth face opposite the third face, wherein the third face and the fourth face are hydrophobic, and wherein the third face comprises a plurality of integrally woven raised structures extending outwardly from the third face, wherein the first zone and the second zone are integrally woven together.

2. The single layer hydrophobic fabric of claim 1, wherein the first face is constructed from a first yarn with a first denier per filament (DPF), and wherein the second face is constructed from a second yarn with a second DPF.

3. The single layer hydrophobic fabric of claim 2, wherein the plurality of integrally woven raised structures on the third face are constructed from a third yarn with a third DPF.

4. The single layer hydrophobic fabric of claim 1, wherein the plurality of integrally woven raised structures extending from the third face are woven with micro-channels within the plurality of integrally woven raised structures.

5. A lower body garment comprising:

a front panel of a first single layer hydrophobic fabric comprising a first outer face and a first inner face that are substantially planar; and a back panel of a second single layer hydrophobic fabric comprising a second inner face and a second outer face, the second single layer hydrophobic fabric further comprising:

a first zone, wherein the second outer face and the second inner face of the second single layer hydrophobic fabric are substantially planar; and a second zone that is seamlessly adjacent to the first zone in a side by side relationship, wherein the second outer face of the second single layer hydrophobic fabric in the second zone comprises a plurality of integrally formed raised structures extending outwardly therefrom.

6. The lower body garment of claim 5, wherein the second zone of the second single layer hydrophobic fabric forming the back panel is adapted to overlay a lower back torso area of a wearer when the lower body garment is worn.

7. The lower body garment of claim 6, wherein the lower body garment comprises a pocket adjacent to an upper portion of a lateral seam line joining the front panel and the back panel, wherein the second zone is configured to extend to an opening of the pocket.

8. The lower body garment of claim 5, wherein the second zone is configured to extend up to a waistband of the lower body garment.

9. The lower body garment of claim 5, wherein the first zone and the second zone of the second single layer hydrophobic fabric are integrally woven.

10. The lower body garment of claim 5, wherein the first zone and the second zone of the second single layer hydrophobic fabric are integrally knit.

11. The lower body garment of claim 5, wherein at the first zone: the second outer face of the second single layer hydrophobic fabric is constructed from a first yarn with a first denier per filament (DPF) and the second inner face of the second single layer hydrophobic fabric is constructed from a second yarn with a second DPF.

12. The lower body garment of claim 11, wherein at the second zone: the plurality of integrally formed raised structures extending outwardly from the second outer face of the second single layer hydrophobic fabric are constructed from a third yarn with a third denier per filament (DPF).

13. A garment comprising:

a first panel of a first single layer hydrophobic fabric comprising a first face and a second face that are hydrophobic and substantially planar; and a second panel of a second single layer hydrophobic fabric comprising a third face and a fourth face, the second single layer hydrophobic fabric further comprising:

a first zone, wherein the third face and the fourth face are substantially planar; and a second zone seamlessly adjacent to the first zone in a side by side relationship, wherein the third face comprises a plurality of integrally woven raised structures extending outwardly therefrom, wherein the first zone and the second zone are integrally woven together.

14. The garment of claim 13, wherein the garment is a lower body garment with the first panel as a front panel and the second panel as a back panel.

15. The garment of claim 13, wherein the plurality of integrally woven raised structures extending outwardly from the third face of the second single layer hydrophobic fabric are constructed from a first yarn with a first denier per filament (DPF), and the substantially planar third face of the first zone of the second single layer hydrophobic fabric is constructed from a second yarn with a second DPF.

16. The garment of claim 13, wherein the garment is an upper body garment with the first panel as a back panel and the second panel as a front panel.

17. The garment of claim 16, wherein the third face of the front panel is an outer face exposed to an external environment, and wherein the second zone is located on a bottom portion of the front panel.

18. The garment of claim 16, wherein the third face of the front panel is an inner face configured to be adjacent to a body of a wearer when the upper body garment is worn, wherein the second zone is located on a top portion of the front panel.

19. The garment of claim 13, wherein the plurality of integrally woven raised structures extending from the third face of the second single layer hydrophobic fabric comprise a plurality of micro-channels within the plurality of integrally woven raised structures.

* * * * *